US006185899B1

(12) United States Patent
De Niet

(10) Patent No.: US 6,185,899 B1
(45) Date of Patent: Feb. 13, 2001

(54) METAL PANEL STRUCTURES

(76) Inventor: Christopher D. De Niet, 1 The Willows, Wamil Way, Wilvenhall, Suffolk IP28 7JU (GB)

( * ) Notice: Under 35 U.S.C. 154(b), the term of this patent shall be extended for 0 days.

(21) Appl. No.: 09/142,230

(22) PCT Filed: Mar. 5, 1997

(86) PCT No.: PCT/GB97/00617

§ 371 Date: Jan. 19, 1999

§ 102(e) Date: Jan. 19, 1999

(87) PCT Pub. No.: WO97/33053

PCT Pub. Date: Sep. 12, 1997

(30) Foreign Application Priority Data

Mar. 5, 1996 (GB) ..... 9604668

(51) Int. Cl.[7] ..... E04B 2/30

(52) U.S. Cl. ..... 52/762; 52/36.4; 52/489.2; 52/775; 211/187; 72/381; 428/603

(58) Field of Search ..... 52/36.4, 762, 775, 52/781.3, 489.2; 211/190, 207, 103, 187; 72/379.6, 381, 383; 428/603

(56) References Cited

U.S. PATENT DOCUMENTS

| | | | | |
|---|---|---|---|---|
| 1,561,556 | | 11/1925 | McMahon . | |
| 3,242,626 | * | 3/1966 | Blok | 52/762 X |
| 3,417,519 | | 12/1968 | Hitter . | |
| 4,270,327 | * | 6/1981 | Van Leeuwen | 52/762 X |
| 4,607,753 | * | 8/1986 | Radek | 211/87 X |
| 4,708,252 | * | 11/1987 | Azzi | 211/187 X |
| 4,796,541 | * | 1/1989 | Halstrick | 211/190 X |
| 5,484,067 | * | 1/1996 | Sothman | 211/87 |
| 5,607,070 | * | 3/1997 | Hellyer | 211/187 X |
| 5,632,178 | | 5/1997 | Uhlemann et al. . | |
| 5,819,578 | * | 10/1998 | Codatto | 72/381 X |

FOREIGN PATENT DOCUMENTS

| | | |
|---|---|---|
| 2651981 | 3/1991 | (FR) . |
| 2123277 | 2/1984 | (GB) . |

* cited by examiner

*Primary Examiner*—Carl D. Friedman
*Assistant Examiner*—Brian E. Glessner
(74) *Attorney, Agent, or Firm*—Dykema Gossett PLLC

(57) ABSTRACT

A structural panel, suitable for use as slatwalling in retail outlets, comprised of a metal sheet bent to define on each side of the panel a series of channels of re-entrant cross-section extending continuously across the width of the panel. The panel is manufactured by a bending process wherein a portion of sheet material is deformed into a U-shaped cross-section, and the sides of the channel are deformed by bending into a substantially S-shape to define the re-entrant channel shape, this process being repeated at regular intervals along the sheet material. The bending process is performed by tooling including first and second tool assemblies, the first assembly including a shaping part for deforming a portion of sheet material into a recess defined between a pair of opposed tool elements of the second tool assembly, the opposed tool elements being driven towards each other to deform the channel side walls into an S-shape.

22 Claims, 20 Drawing Sheets

METAL PANEL STRUCTURES

BACKGROUND OF THE INVENTION

This invention relates to structural panels formed from sheet metal material and having channels extending across their width.

So-called slatwall panels are employed in retail outlets where the panels are generally mounted on walls. The panels, which are commonly made of wood have grooves extending horizontally across the width of the front face of the panels, these grooves allowing brackets or other similar support members to be attached to the panel at selected points, and the support members being used to carry products on display and for sale.

The aim of the present invention is to provide an alternative to the known wooden slatwall which can be cheaper to manufacture and more versatile in use.

SUMMARY OF THE INVENTION

In accordance with one aspect the invention resides in a structural panel formed from sheet material, the sheet material being bent to form on each face of the panel a series of parallel channels with the same re-entrant cross-sectional shape.

In a preferred construction each of the side walls of each channel is defined by a metal section of substantially S-shaped cross-section. Furthermore, the channels on one side of the panel have the same cross-sectional shape as those on the other side of the panel, enabling similar support members to be attached to both sides of the panel. This enables a single structural panel to be utilised in assembly of a partition wall structure to be positioned within the area of a shop floor and allowing products to be easily supported on and displayed to both sides of the partition wall.

In accordance with a second aspect the invention provides a method of bending sheet metal in the production of a sheet metal panel having channels extending across the width thereof, wherein a sheet portion is deformed by bending into a substantially U-shaped cross-section to form the base of a channel and two opposed sides, and the sides are deformed by bending into substantially S-shape to form a channel with a re-entrant cross-section.

In the manufacture of a metal slatwall panel as provided in accordance with the invention, the bending process is repeated at regular intervals along the sheet to define a series of parallel channels of essentially the same cross-section. Preferably the bending and shaping tools used in the process are so configured that between adjacent channels formed by the method described above are defined channels of substantially equal cross-section but open to the opposite face of the panel.

The invention also resides in tooling for carrying out the process including two tool assemblies, the first assembly including a shaping part for deforming the sheet portion into a recess defined between a pair of opposed tool elements of the second tool assembly, thereby to deform the sheet portion into a channel of U-shaped cross-section, the tool elements of the second assembly being movable towards each other for deforming the side walls of the channel into substantially S-shape.

The first tool assembly includes tool elements, conveniently pivotally mounted, which are movable to release the shaped metal channel section from the tooling.

The invention also provides a structural panel of the form mentioned above in combination with a support clip having a snap engagement into a channel of the panel and arranged to be firmly supported thereon without bearing against the panel outwardly of the channel.

A clear understanding of the invention in its various aspects will be gained from the following detailed description in which reference is made to the accompanying drawings.

BRIEF DESCRIPTION OF THE DRAWINGS

FIG. 32 is a perspective view showing a further form of attachment clip suitable for supporting a shelf or the like.

DETAILED DESCRIPTION OF THE PREFERRED EMBODIMENTS

Figure 1:
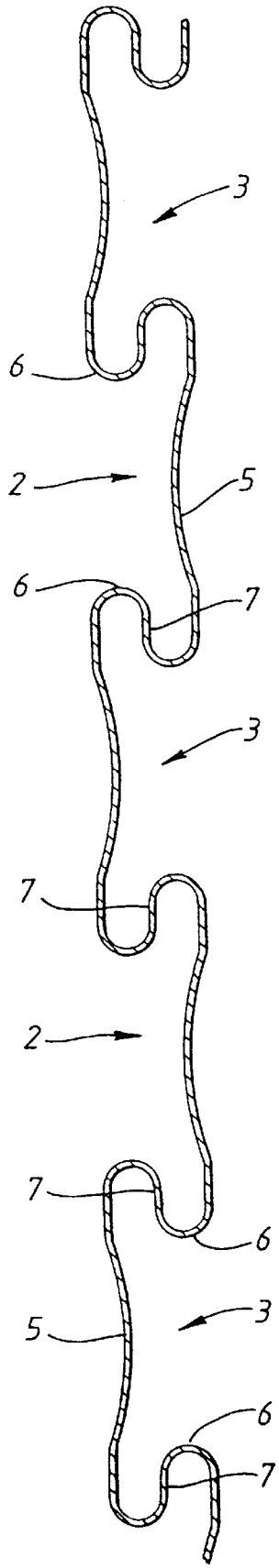
FIG. 1 is a partial cross-section through a sheet metal panel embodying the invention.

The structural panel of sheet metal material shown partially in FIG. 1 is substantially rigid and very robust. It may be more than one meter in height e.g. around 3 meters, and more than half a meter, e.g. around 1.2 meters in width. The sheet metal from which the panel is manufactured is deformed by bending to form a series of equal parallel channels 2 on one side of the panel, and to form simultaneously a series of equal channels 3 open to the other side of the panel, the channels on both sides having essentially the same cross-section. Each channel 2,3 includes a base wall 5 and opposed side walls 6. The base wall could be flat, but as shown includes a central part which is convexly curved towards the mouth of the channel. The side walls have cross-sections of S-shape defining recesses facing in opposite directions and separated by a wall part 7 which is substantially parallel to the base wall 5. Due to the shape of the side walls 6, the channels have a re-entrant configuration.

Due to the panel symmetry, i.e. with channels 2,3 of essentially identical form on both sides, support brackets, clips or other such devices can be interlocked with the channels on either side of the panel. The width and depth of the channels 2,3 is not crucial, but suitably for a slatwall panel, the maximum width may be from 4 to 8 cms, e.g. 6 cms, the minimum width about 3 to 5 cms less than the maximum width, e.g. 4 cms, and the depth 1 to 3 cms, e.g. 2 cms.

Figure 2:
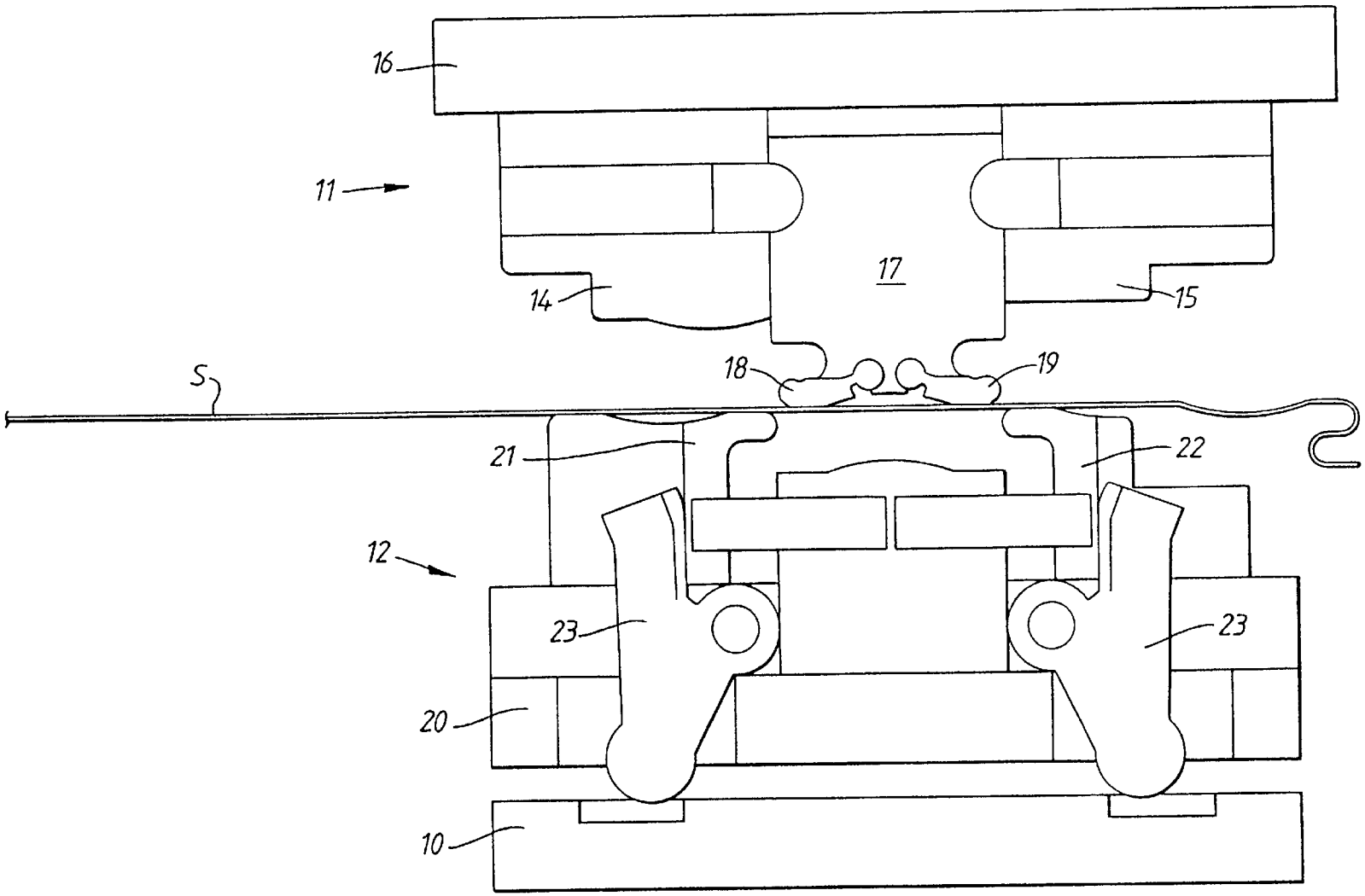
FIG. 2 illustrates the tooling used in production of the panel shown in FIG. 1, and shows an initial stage in a channel forming process.

The tooling used to produce the panel, and the various stages involved in the process of bending the metal sheet to form each of the channels are illustrated in FIGS. 2–6. The tooling includes a stationary bed plate 10 of a pressing tool and upper and lower movable tool assemblies 11,12. The upper assembly includes a pair of elongate tool parts 14,15 firmly attached to a platen 16, and a central tool member 17 located between the parts 14,15 and having at its lower end a pair of oppositely directed pivotal tool elements 18,19. In an operative shaping adjustment position of the tool elements 18,19, as shown in FIG. 2, these tool elements define together with the lower end portion of the tool member 17 the internal shape of the channel 2 to be formed.

The lower tool assembly 12 comprises a platen 20 supporting a central tool member 24 having an upper face shaped for cooperation with the central tool member 17 of the upper assembly, a pair of opposed lateral tool elements 21,22 guided for sliding movement towards and away from each other between opened and closed positions, and levers 23 having lower arms abutting the bed plate 10 and upper arms engaging the tool elements 21,22 so that when the lower tool assembly is moved towards the bed plate 10, the levers 23 rotate and drive the tool elements 21,22 towards each other. It will be appreciated that the tool components which are effective in shaping the sheet metal have a length sufficient to extend the full width of the sheet being shaped.

Figure 3:
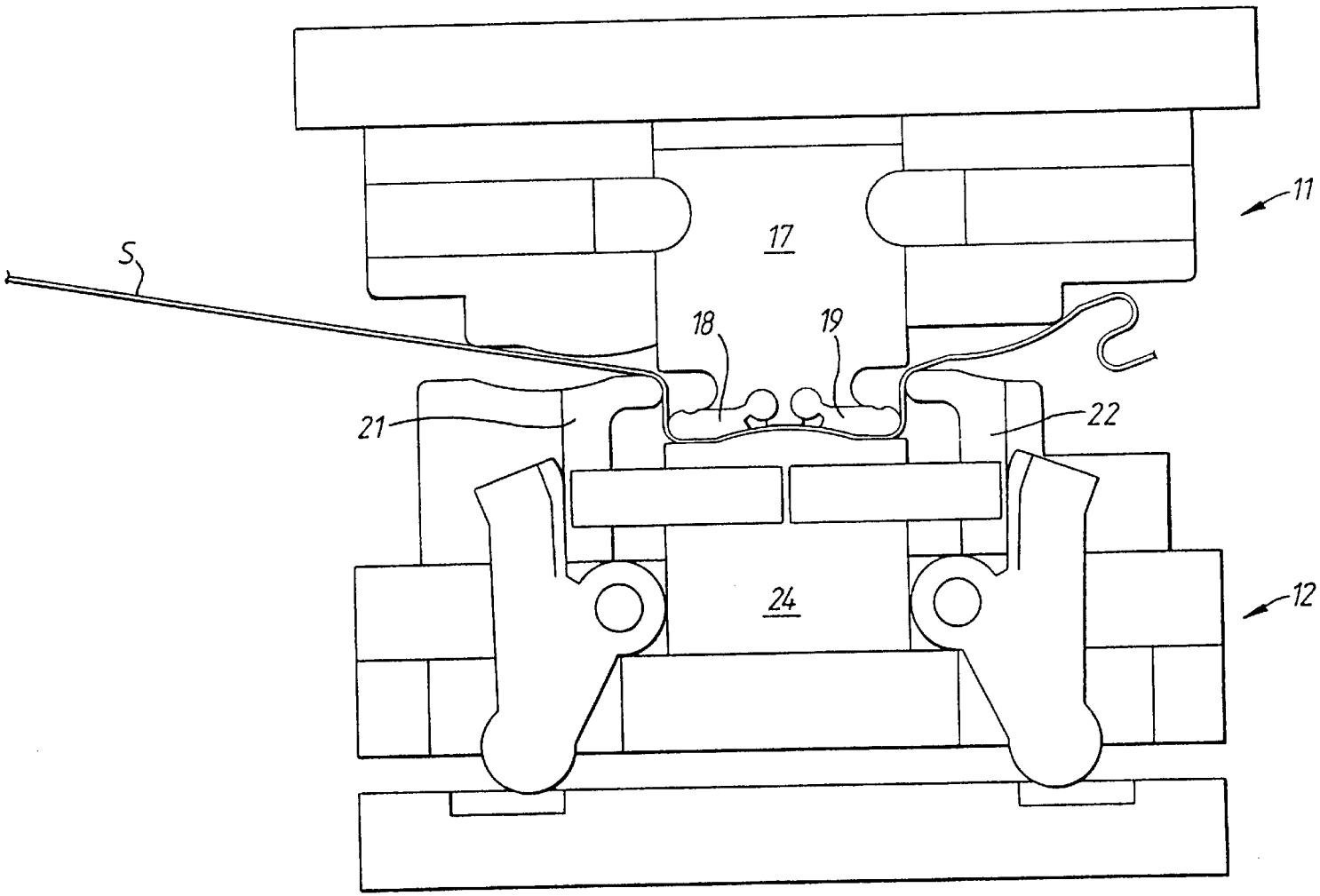
FIGS. 3–6 show in succession further stages of the forming process.
Figure 4:
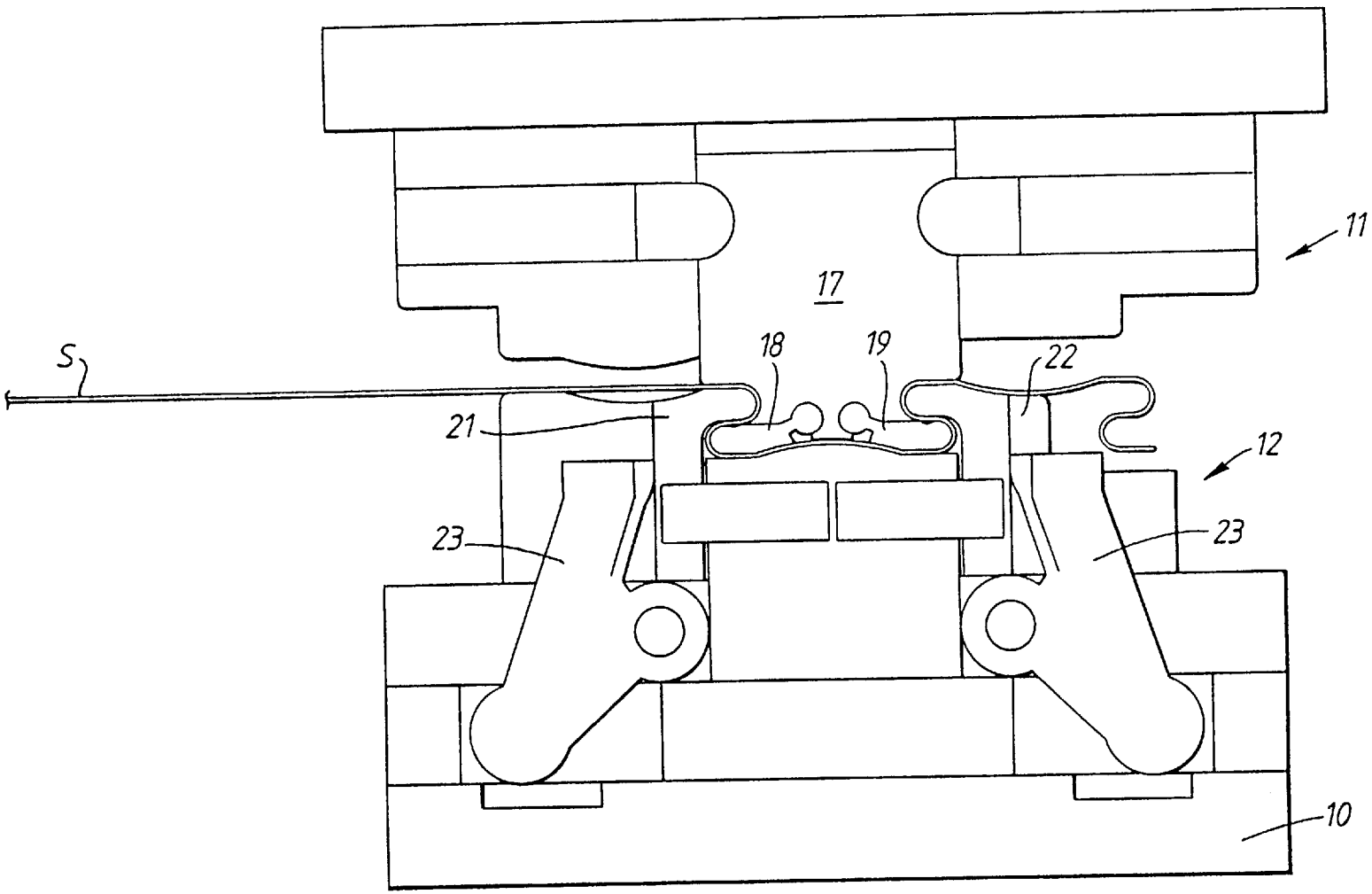

The tool assemblies 11,12 are initially raised and opened apart, and a portion of plane sheet metal S is positioned between them as shown in FIG. 2. The upper tool assembly 11 is driven down so that the central tool member 17 and its tool elements 18,19 force the sheet metal downwardly between the tool elements 21,22 and eventually against the top face of the tool member 24, thereby producing a substantially U-shaped channel in the metal sheet as illustrated in FIG. 3. As the upper tool assembly 11 continues to move downwardly, the lower assembly 12 then moves with it thereby causing the levers 23 to pivot to displace the tool elements 21,22 inwardly towards each other and deform each of the side walls of the U-shaped channel into an S-shape and into close conformity with the central tool member 17 of the upper assembly, so that the metal sheet acquires the desired channel configuration, as depicted in FIG. 4.

Figure 5:
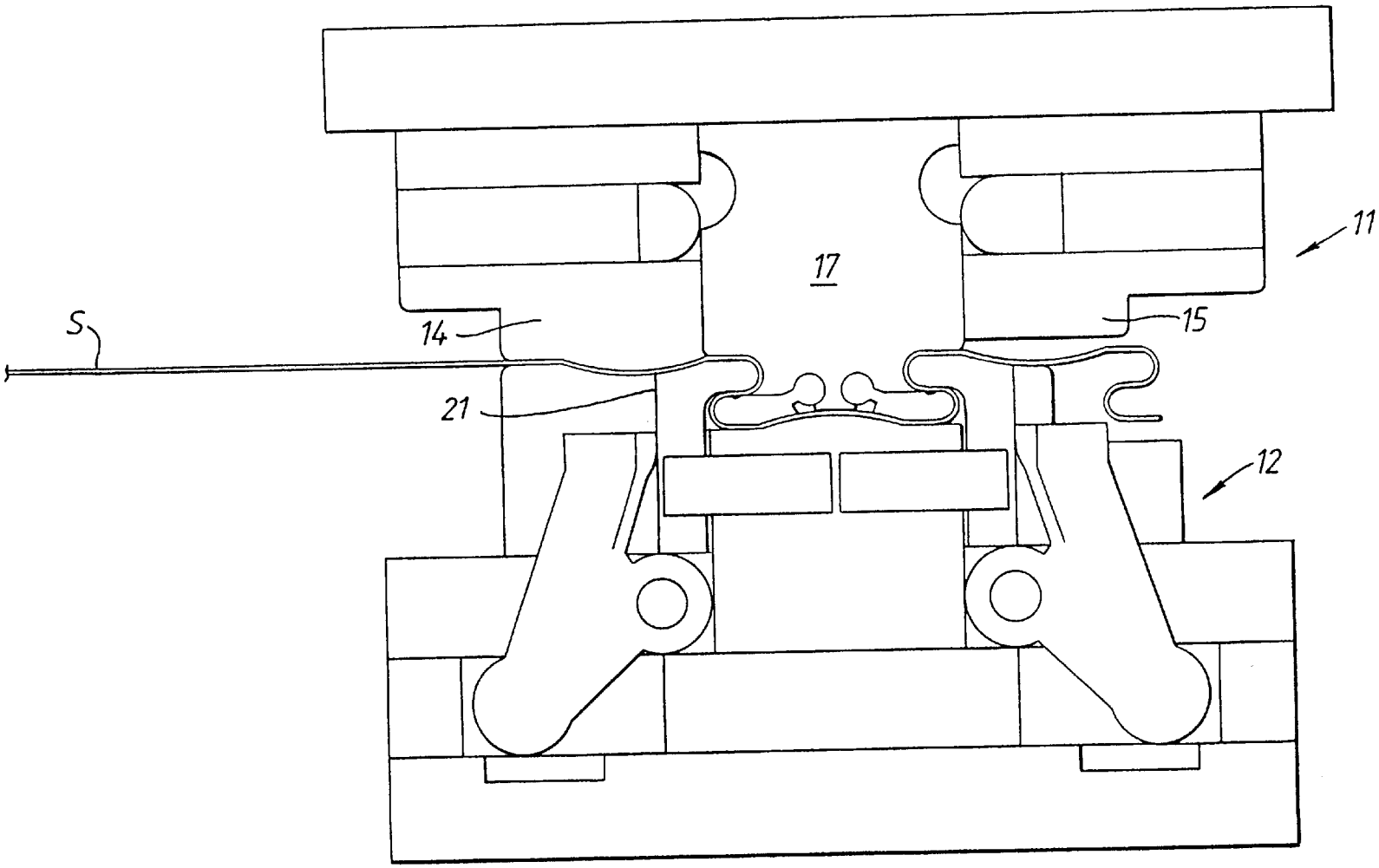

In order to produce in the sheet metal portion adjoining the channel thus formed a depression replicating that formed in the underside of the channel base wall by the tool member 24, the central upper tool member 17 is unlocked from the adjacent tool parts 14,15 and the latter are lowered so that the part 14 shapes the relevant portion of sheet metal against the upper surface of the tool element 21, as illustrated in FIG. 5.

Figure 6:
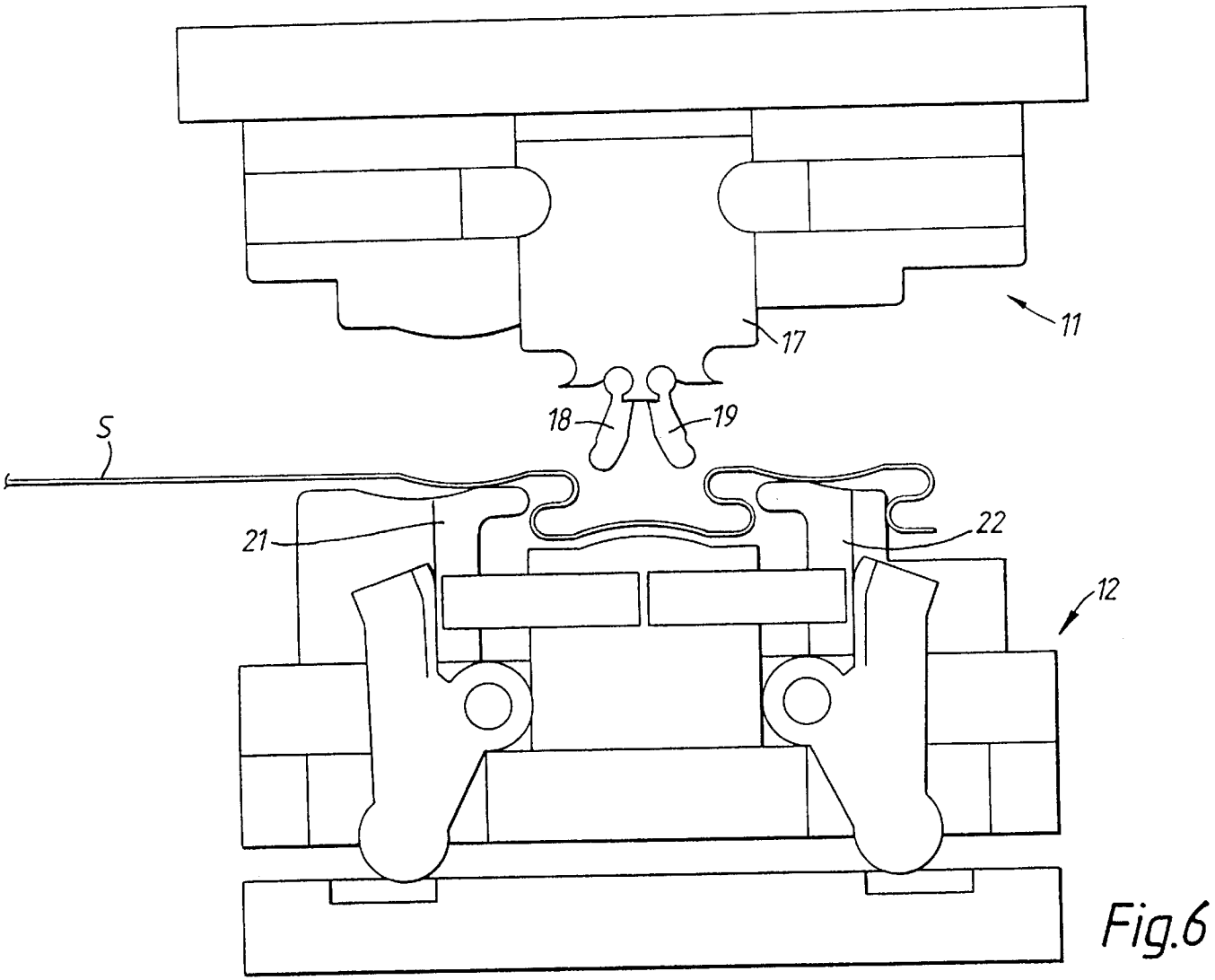

The tool assemblies 11,12 are then raised and opened apart to release the shaped panel section and prepare the tooling for the next pressing operation. The tool elements 21,22 are opened apart to release the tool member 17, and as the latter is raised the tool elements 18,19 pivot downwardly to enable them to be withdrawn from the channel as shown in FIG. 6.

The channel forming process is repeated at regular intervals along the metal sheet S so that a panel of the form shown in FIG. 1 is obtained. Of course, if desired sections of panel can be left flat and without channels, such as at the ends of the panel should this be desired.

Figure 7:
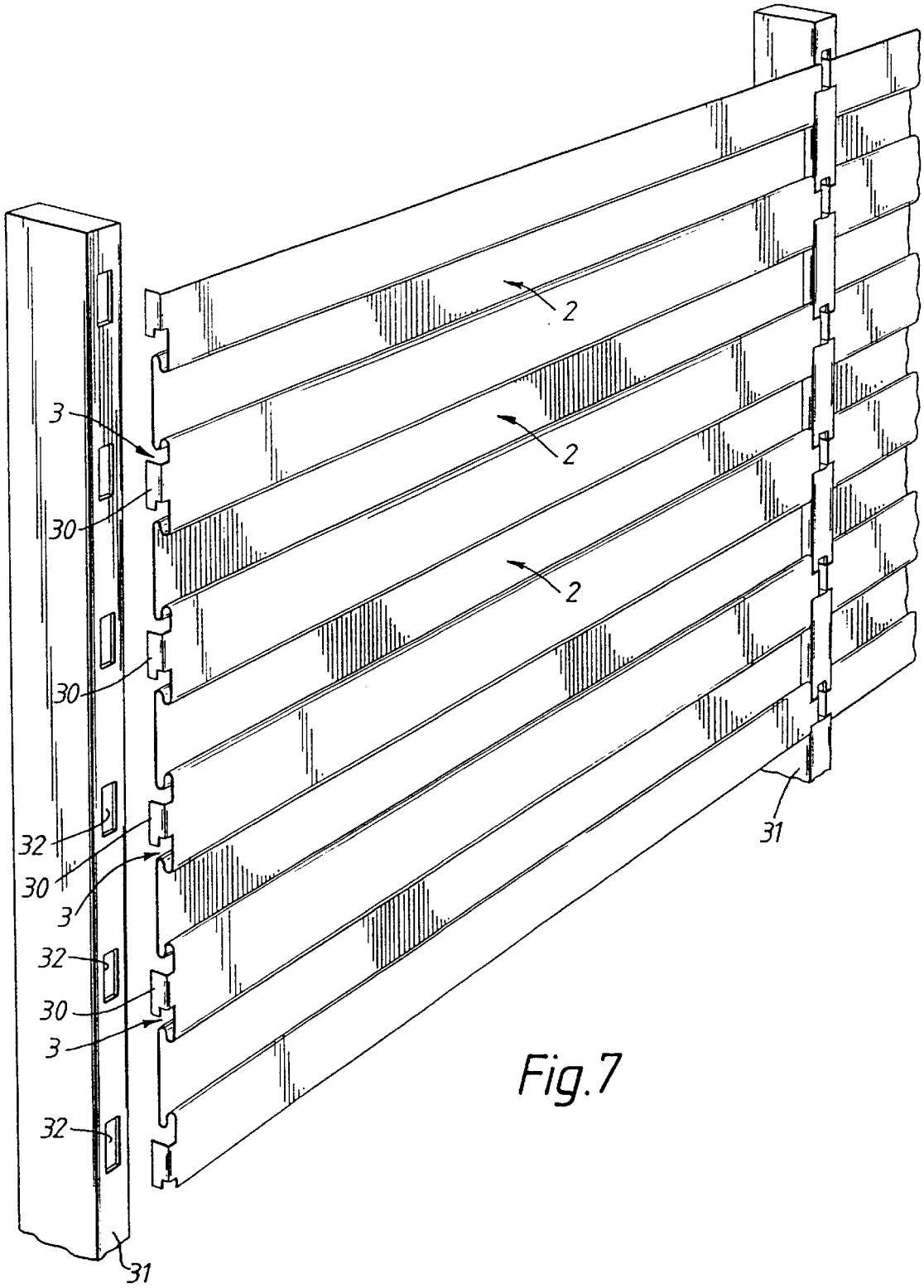
FIG. 7 is a perspective view of a slatwall assembly including a metal panel in accordance with the invention.
Figure 8A:
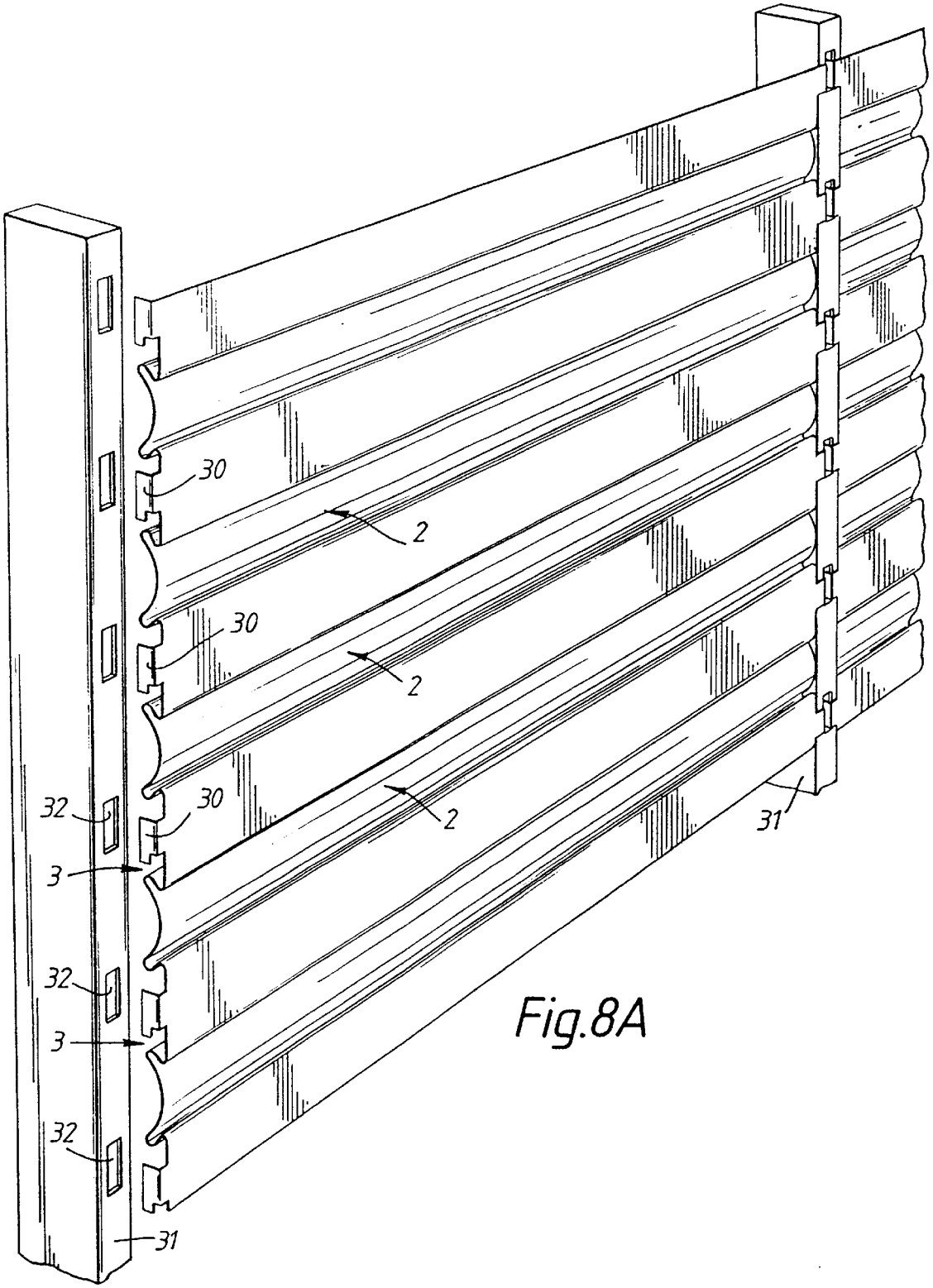
FIG. 8A is a perspective view of another slatwall structure.

The metal panels of the invention are ideally suited for erection of slatwalling and are of particular advantage in the construction of co-called "gondola" structures or stands to be erected other than against a wall since they provide equal channels on both sides of the panel. FIG. 7 illustrates a panel generally similar to that described above, but having channels with base walls which are flat. Integral tabs at the ends of the base walls of the channels 3 are bent to form hooks 30 enabling the edges of the panels to be interlocked with tubular support posts 31 having slots 32 to receive the hooks 30. Adjacent panels can be interlocked with the same support posts to form a continuous wall structure, as illustrated. A generally similar wall structure is shown in FIG. 8A, but the panels are different in that the base walls of the channels 2 are convexly curved towards the channel mouths, whereas the base walls of the channels 3 are flat. Of course other possibilities for shaping the base walls of the channels 2,3 also exist and they could for example be bent to curve away from the channel mouths or indeed to curve in both directions with a corrugation effect.

Figure 8B:
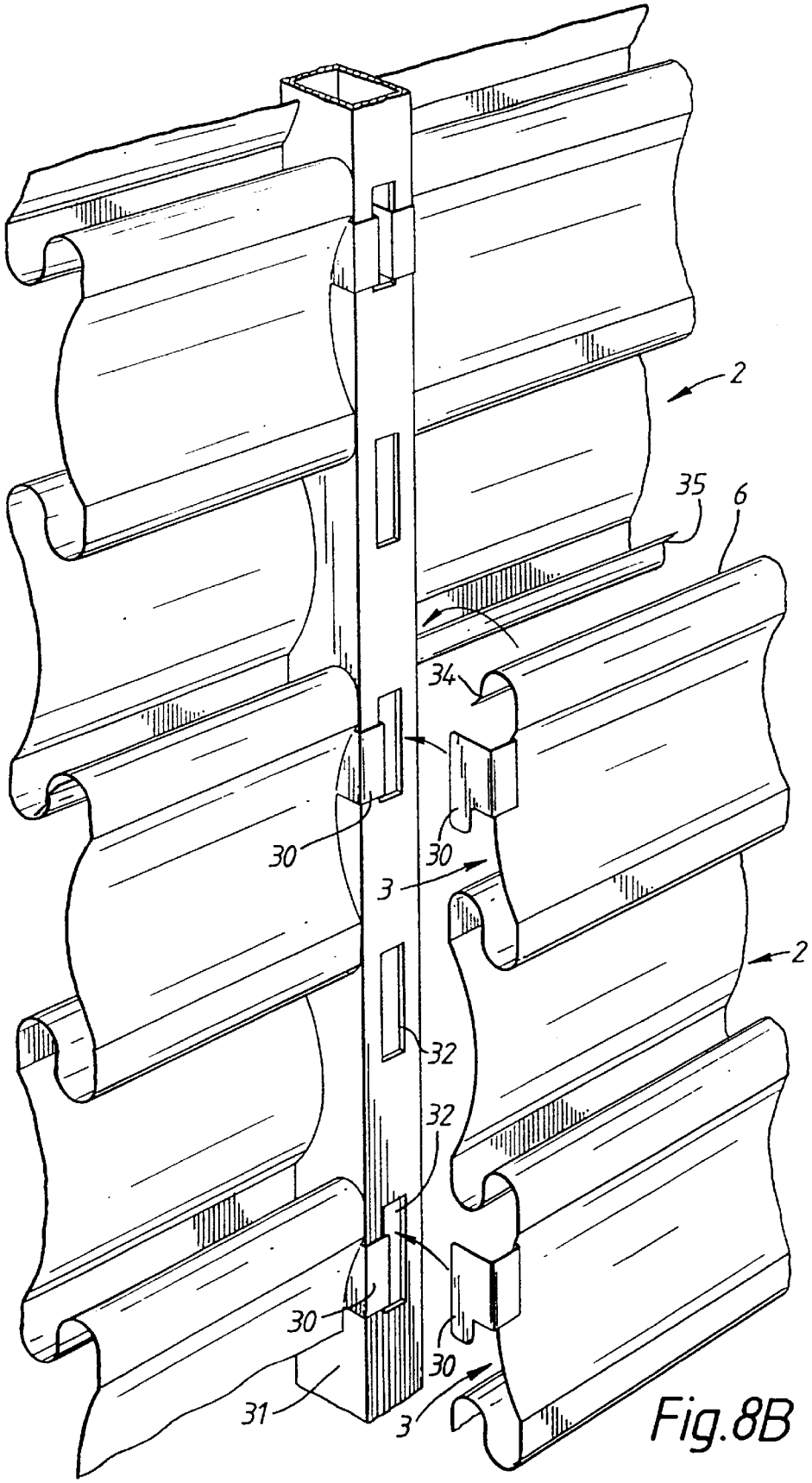
FIG. 8B is a perspective view of a further slatwall assembly.

FIG. 8B shows part of a wall structure assembled from panels of essentially the same form as that of FIG. 1, the panels being provided with hooks 30, formed by integral tabs, for interlocking the ends of the panel with tubular, rectangular section posts 31 having slots 32 to receive the hooks of adjacent panels. The hooks are provided at the ends of the base walls of the channels 3 which face rearwardly as viewed in FIG. 3. As these base walls are not flat, e.g. as they are in FIG. 7, the tabs are formed so that they extend forwardly from the base wall, and then laterally and rearwardly so that the hooks in effect wrap around a post edge portion when properly engaged with a post slot. FIG. 8B also shows how the panels can be terminated at the top and bottom edges to allow panels to be interlocked so that they can be mounted one above another without any apparent discontinuity between them. The upper edge of the panel is formed with a downwardly open hook portion 34 formed by part of the upper side wall 6 of the uppermost channel 3 which is facing rearwardly. The lower edge of each panel is formed with a corresponding upwardly directed hook portion 35 on the opposite, i.e. front side of the panel, formed by the lower side wall of the lowermost channel 2 which is facing to the front. The hook portion 34 of a lower panel can be engaged with the hook portion 35 of an upper panel to provide a continuous vertical panel structure without any apparent join. When the lower panel is mounted on the support post 31, as indicated by the arrows, the extreme edge of the hook portion 34 is brought to lap behind the extreme edge of the hook portion 35, whereby the appearance of a continuous panel is achieved. This technique of joining panels with a lapping engagement opens up the possibility of easily changing colours over the height of an assembled wall by mounting a series of panels of selected colour one above the other.

Figure 9:
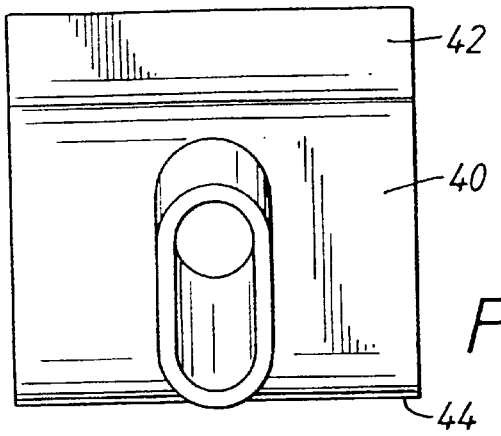
FIGS. 9, 10 and 11 show a clip for use with the panel of FIG. 1 in front, side and rear elevation respectively.
Figure 10:
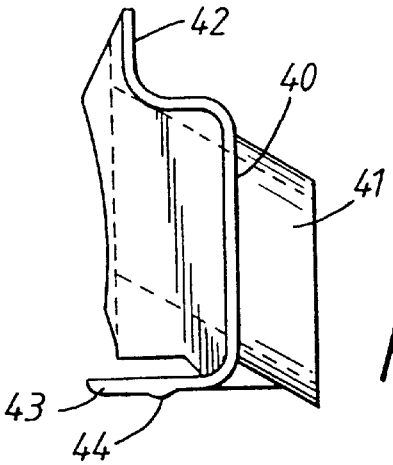
Figure 11:
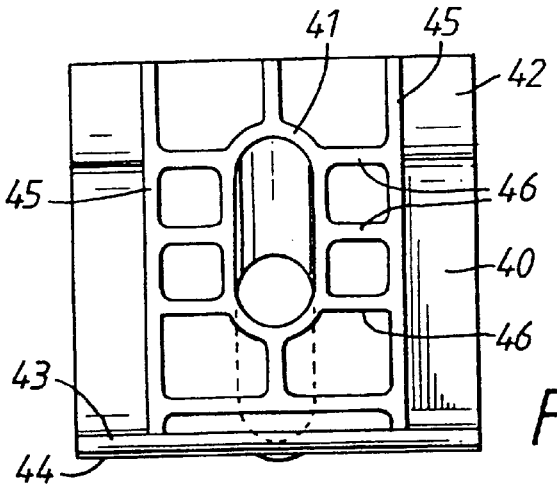
Figure 12:
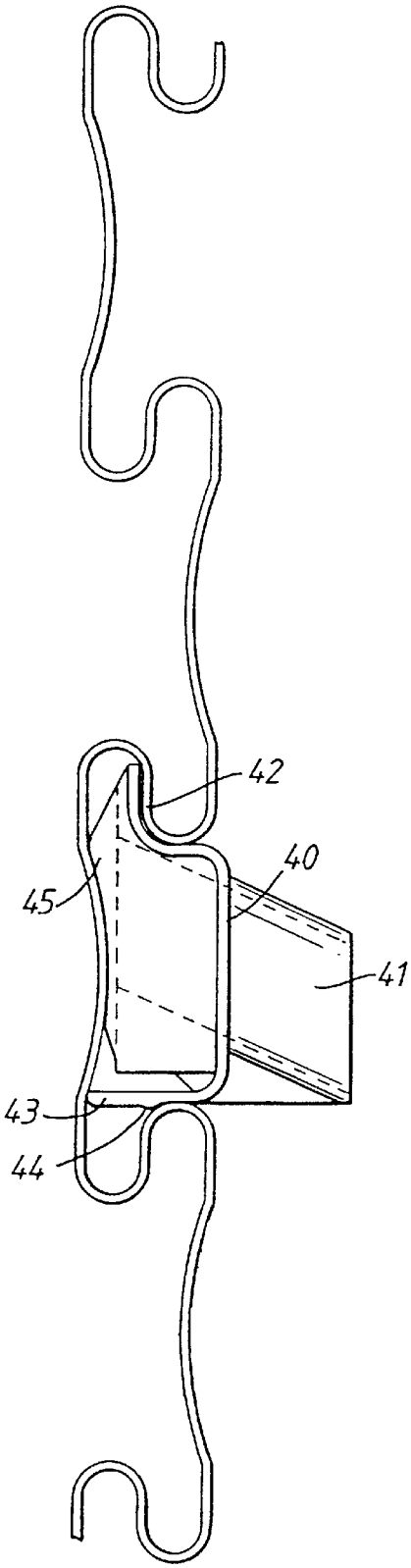
FIG. 12 shows a clip similar to that of FIGS. 9–11 fitted to the panel.

A novel form of attachment clip for snap engagement into one of the channels 2,3 of the sheet metal panel shown in FIG. 1, is illustrated in FIGS. 9–11. The clip is made as a plastics moulding and has a front plate 40 through which extends a tubular part 41 of oval cross section. Attached to the upper edge of front plate is a rearwardly and upwardly extending mounting portion 42 of L-shaped section and from the lower edge of front plate extends a horizontally rearwardly directed mounting portion 43 having on its lower face a snap-in location projection in the form of a longitudinal rail 44. To the rear of the front plate are upright and transverse reinforcing webs 45,46 to improve rigidity, these webs interconnecting the tubular part, the front plate and the upper mounting portion, but not the lower mounting portion 43 which needs to flex when connecting the clip to a panel. The rear edges of the upright webs are shaped to conform to the base wall of a panel channel into which the clip is fitted. The tubular part 41 defines a socket and may be shaped according to the form of the member which it is to receive and is moulded to support that member in a desired orientation. As shown in FIGS. 9–11 the tubular part defines a socket for retaining an oval section rail which is inclined downwardly at 30° to the horizontal. FIG. 12 shows a singular clip, but designed to bold a rail downwardly inclined at 25°, operatively mounted on a panel. To fit the clip to the panel the upper mounting portion 42 is inserted into the downwardly facing recess of the upper side wall of the channel, and the clip is rotated. The lower mounting portion 43 flexes to enable the locking rail 44 to pass over and engage behind the panel section defining the lower edge of the channel mouth. As loading forces applied to the clip in use tend to rotate it so that the lower mounting portion 43 is urged towards the channel base wall and the upper mounting portion 42 is urged away from the base wall, the clip remains securely fixed in place. An important advantage is gained by the feature that the mounting clip does not bear against the panel outside of the channel into which it is fitted. Slatwall panels known hitherto have tended to become marred in appearance as a consequence of being marked with lines due to movement of mounting clips and brackets when adjusting their portions and to collection of dirt at the edges of areas where the clips and panels are in contact. With the clips of the invention any surface blemishes of this type will be contained within the channels and remain concealed from view.

Figure 13:
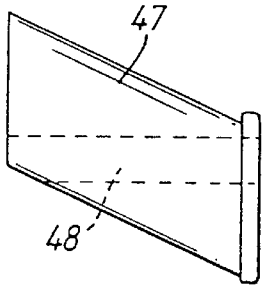
FIGS. 13 and 14 show in front and side elevation an adaptor for use with the clip of FIG. 12.
Figure 14:
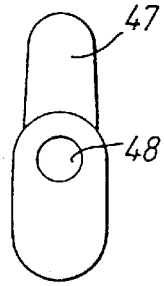
Figure 15:
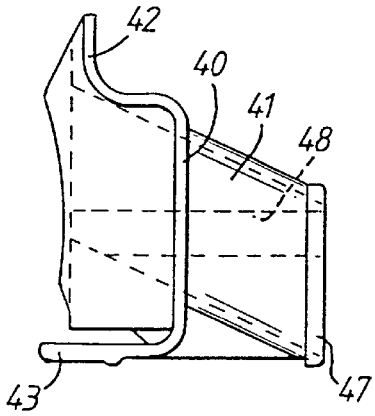
FIG. 15 shows the adaptor of FIGS. 13 and 14 fitted to the clip.
Figure 16:
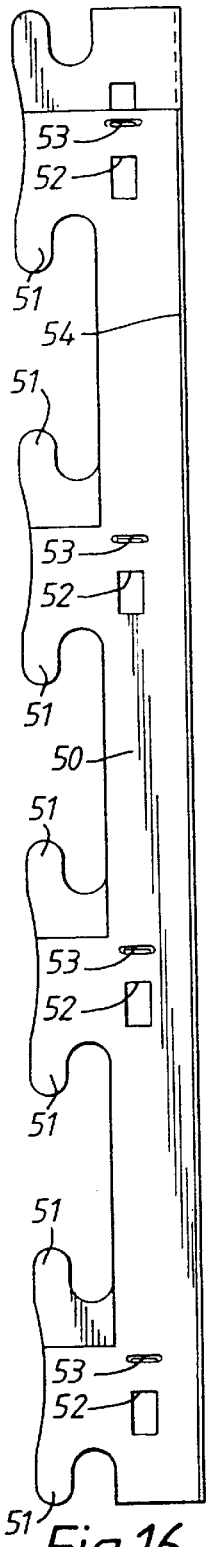
FIG. 16 is a side view showing a stiffening bar for use with the panel of FIG. 1.
Figure 17:
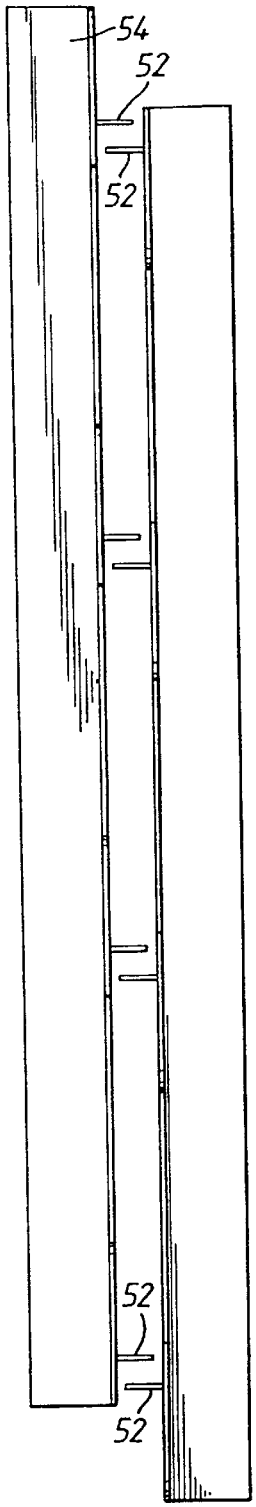
FIG. 17 is a front view showing the two separated parts of the stiffening bar of FIG. 16.
Figure 18:
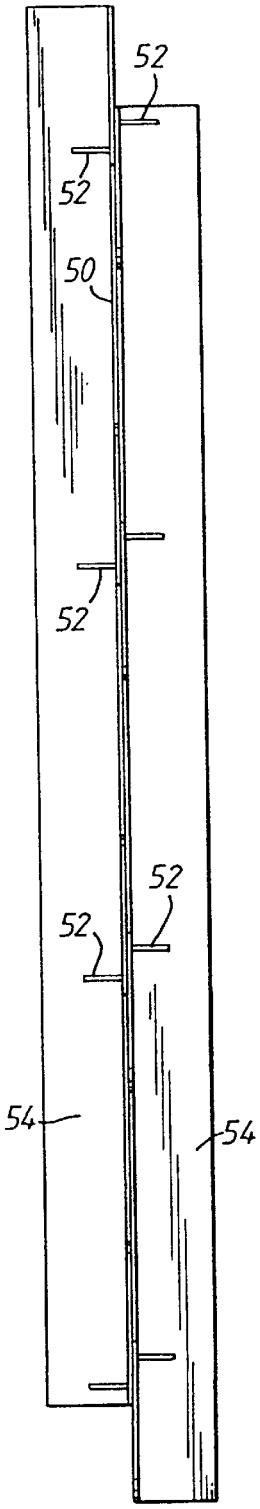
FIG. 18 is a view corresponding to FIG. 17 and showing the bar parts in co-operative assembly.
Figure 19:
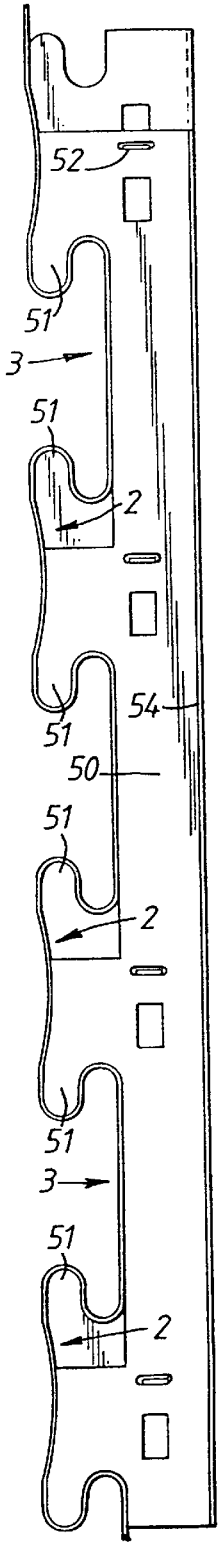
FIG. 19 is a side view showing the stiffening bar in conjunction with the panel.

As mentioned above it is not essential for the tubular part of a clip to define a downwardly inclined socket and it could extend horizontally for example. FIGS. 13–15 illustrate an adaptor insert for use with the clip of FIG. 12 to enable it to carry a horizontal rod. The adaptor is shaped as a plug 47 to fit the clip socket and has a bore 48 to receive the end of the rod to be supported.

Figure 20:
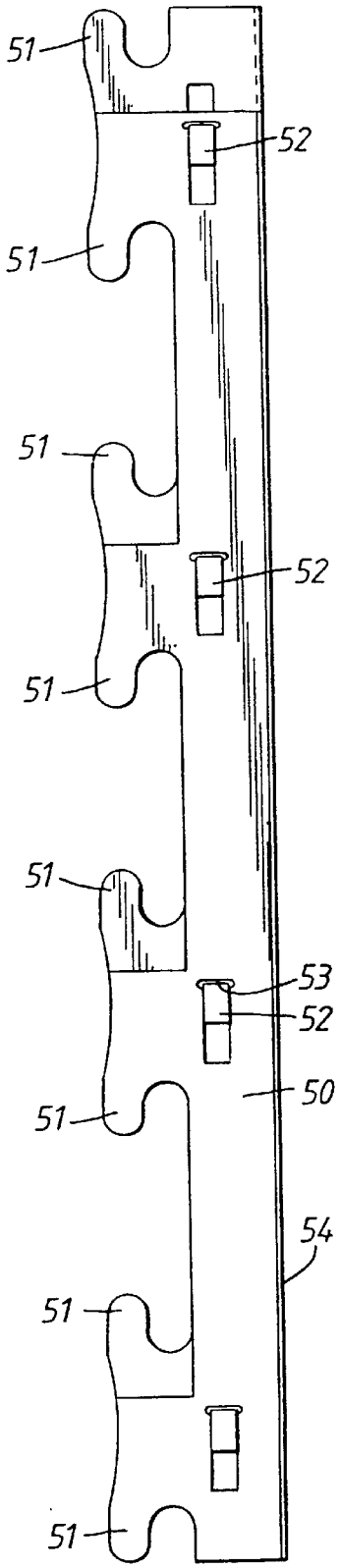
FIGS. 20 and 21 are side and front views, respectively, of the fully assembled stiffening bar.
Figure 21:
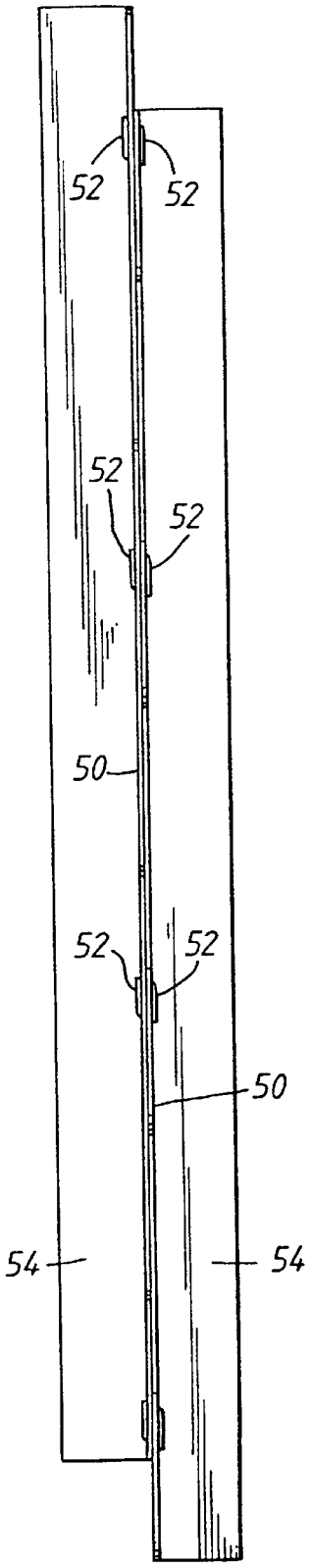

The sheet metal panels may be substantially rigid and capable of resisting and bending under normal handling and reasonable loading. If they are to be subjected to a heavy loading on one side, however, tendency for the panels to buckle can be resisted by applying strengthening bars to the other side of the panel in order to stiffen the panel. Such a bar and its application to a panel of the form shown in FIG. 1 is illustrated in FIGS. 16–21. The bar is formed from two equal angle sections which are applied back-to-back. Each section has a spine 50 from which extends a series of four tabs 51, each of which is shaped to fit the internal profile of one side wall of the panel channel 2,3. The spine has tags 52 bent out of the plane of the spine and at a short distance from these tags respective slots 53. The tags initially project oppositely to the flange 54 at the outer edge of the spine. One angle section is introduced to the panel so that its tabs 51 engage in adjacent channels 2 and interfit with one side wall of that channel, and the second angle section is applied to the panel in reversed orientation so that its tabs are inserted into the same channels 2, but engage in the recesses of the other side walls. The two angle sections are then brought together so that the spines abut, the tags 52 of each section passing through the slots 53 of the other section. Finally, assembly of the stiffening bar is completed by bending over the tags 52 as depicted in FIGS. 20 and 21.

Mounting brackets of essentially the same form as the above described reinforcing bar can be used to mount the panel of the invention to a supporting structure, such as a wall. For this purpose the flanges 54 of the angle sections could be provided with keyhole slots for cooperation screw fasteners or the like.

Figure 22:
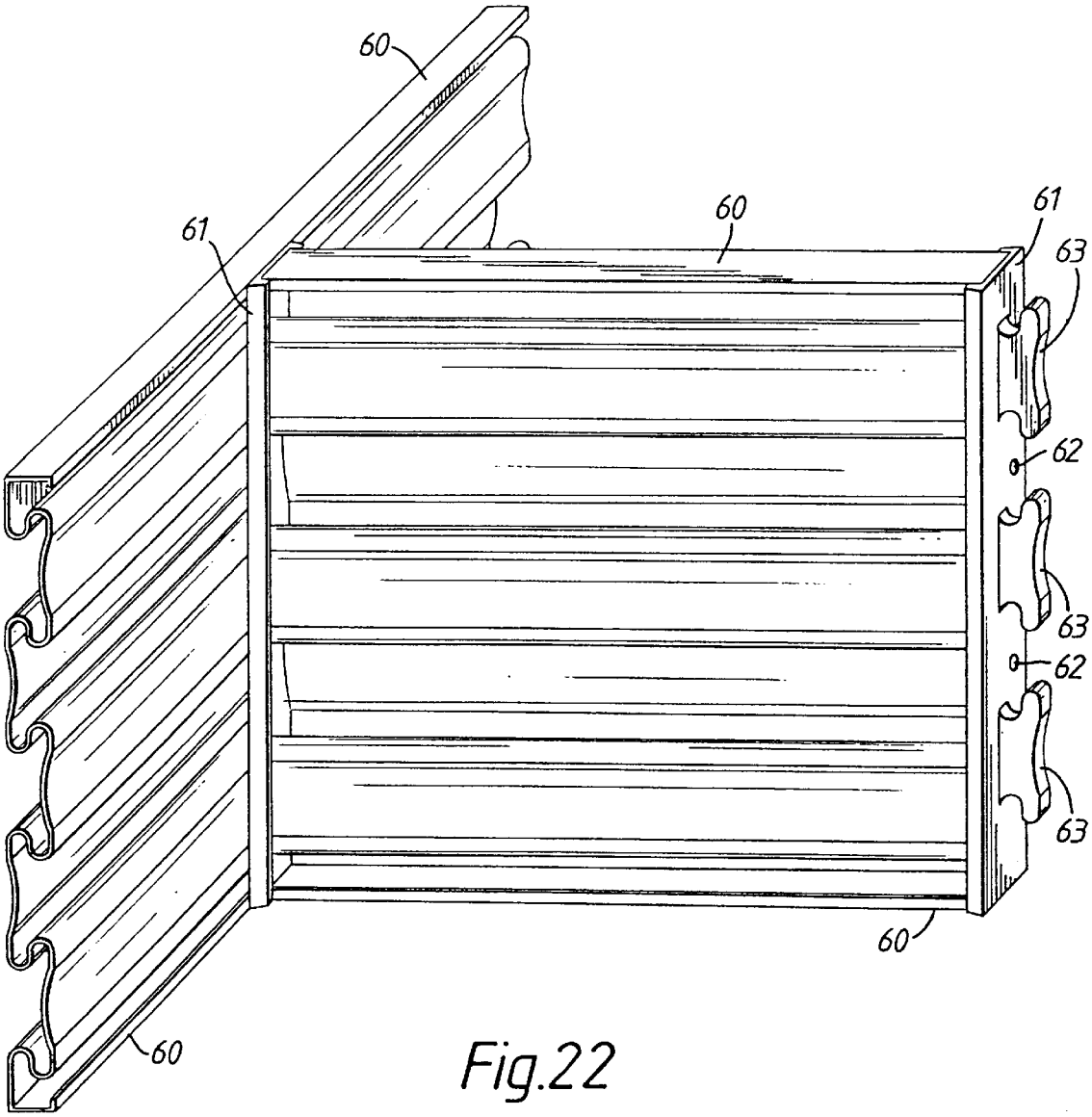
FIG. 22 shows in perspective two panel connected to a T panel arrangement.

In FIG. 22 there is illustrated a panel which is formed with channels as the panel of FIG. 1, but differs in that the top and bottom panel edges are finished with substantially L-shaped flanges 60. FIG. 22 also shows one way in which two such panels can be interconnected in a T formation. Edge fittings 61 are attached to the vertical edges of the second panel, these fittings being shaped to wrap around the panel edge and being secured to the panel such as by means of screws 62. Fixedly secured to the edge fittings are cleat-shaped projections 63 which match the cross-section of the channels 2,3 formed in the panels. To connect the second panel at 90° to the first panel, the projections 63 are inserted into the channels 2 or 3 of the first panel and slid along those channels until the second panel is in the desired position. It will be understood that in this way various stable panel structures with interconnected panels can be created. The panel edge fittings 61 can conveniently be made as plastics mouldings.

While the invention has been described herein above with particular reference with slatwall applications, it will be understood that it is also suitable for a broad range of other applications. For example, it could be used with advantagt to provide partitioning separating bays in a workshop where the channels would provide suitable anchorages for tool carrying supports. Furthermore, modifications to the described embodiments are possible without departing from the scope of the invention. For purposes of illustration the following examples may be mentioned. To provide an improved appearance the vertical edges of a panel can have an edge trim applied thereto such as by means of spot-welding, the edge trim effectively closing off the ends of the channels 2,3. The edge trim may include flanges or other formations as may be desired for mounting the panel. Thus, rather than books being formed on the panel itself as shown in FIGS. 7 and 8 such hooks could be provided by an edge trimming strip.

Figure 24:
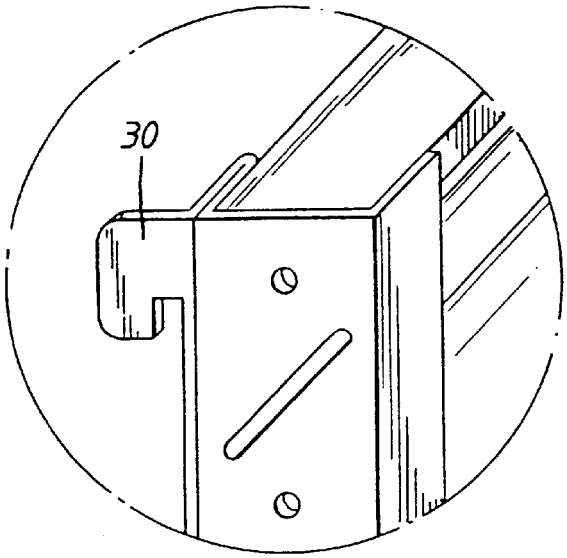
FIG. 24 shows the circled portion of FIG. 23 on an enlarged scale.
Figure 23:
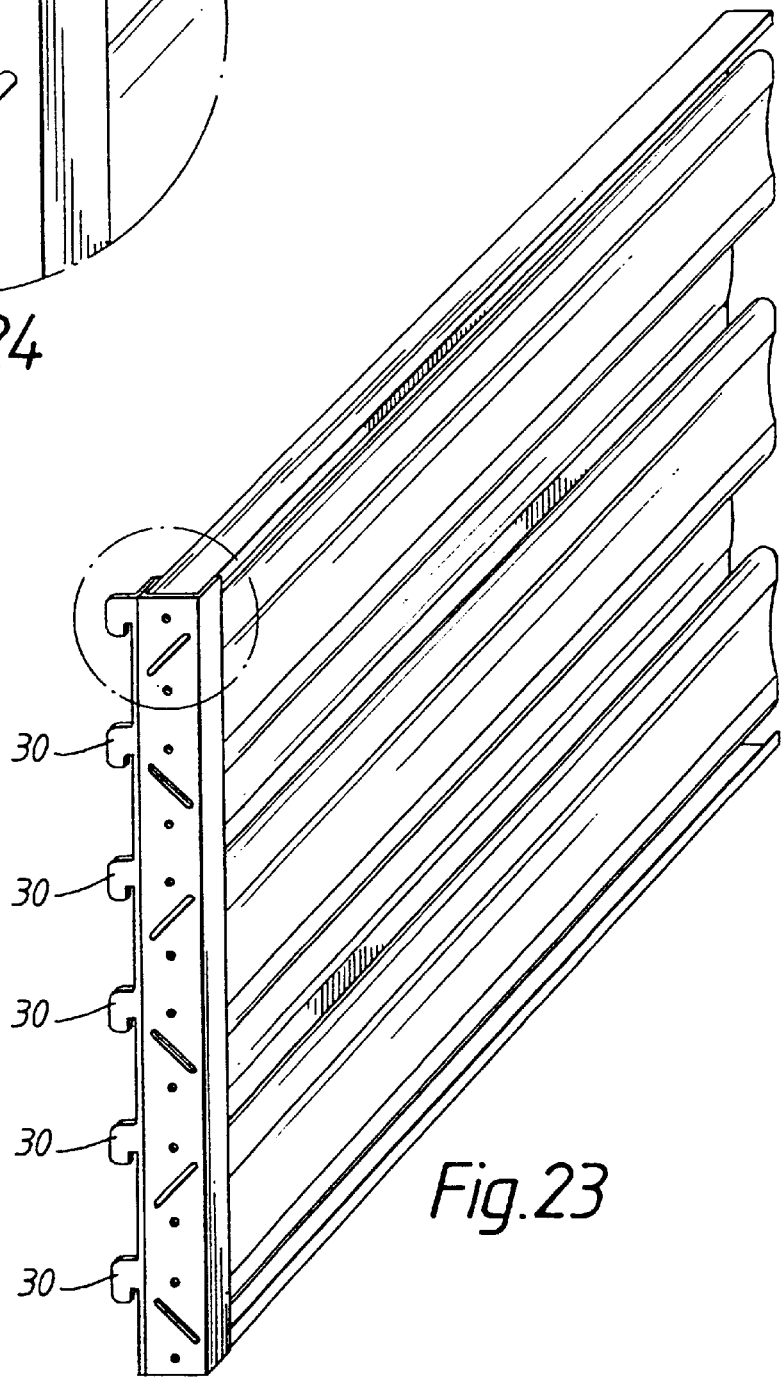
FIG. 23 is a perspective view showing a panel fitted with an edge strip.
Figure 25:
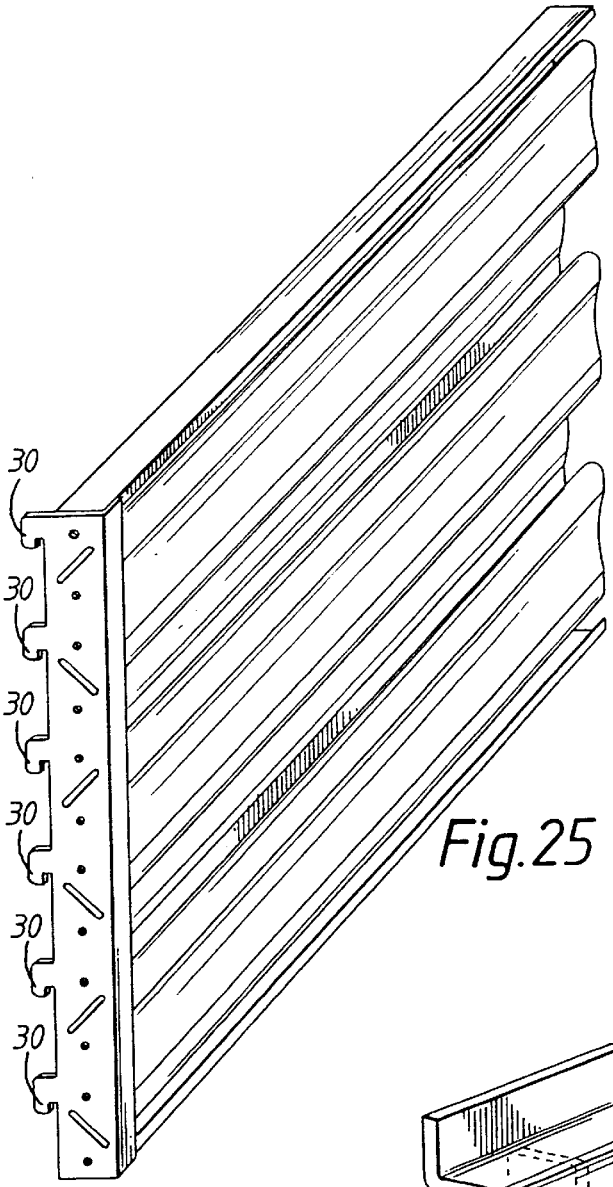
FIG. 25 is a perspective view of a panel with an alternative edge strip.
Figure 28:
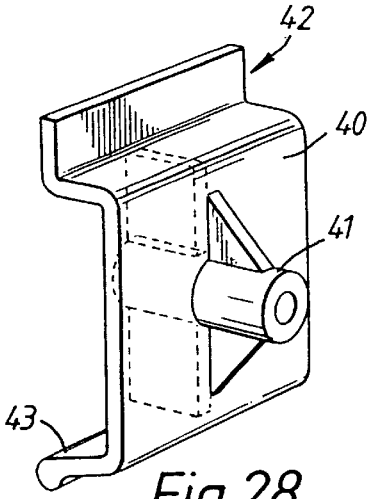
FIGS. 28 and 29 are perspective and side views respectively of an alternative attachment clip.
Figure 29:
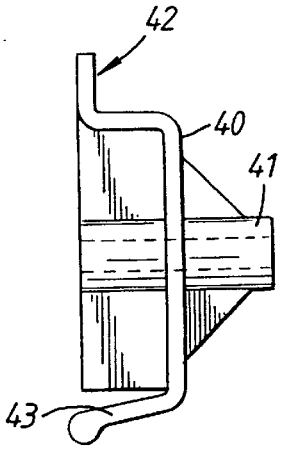
Figure 27:
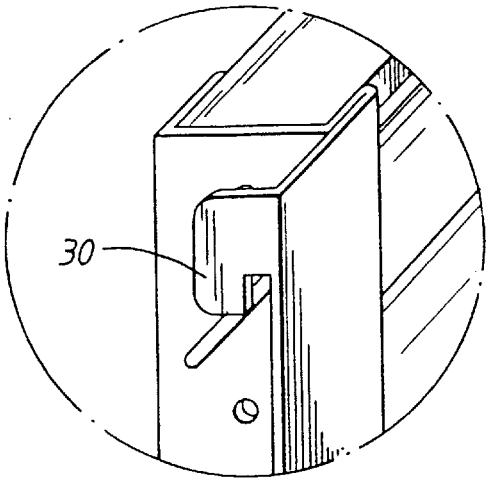
FIG. 27 shows the circled part of FIG. 26 on an enlarged scale.
Figure 26:
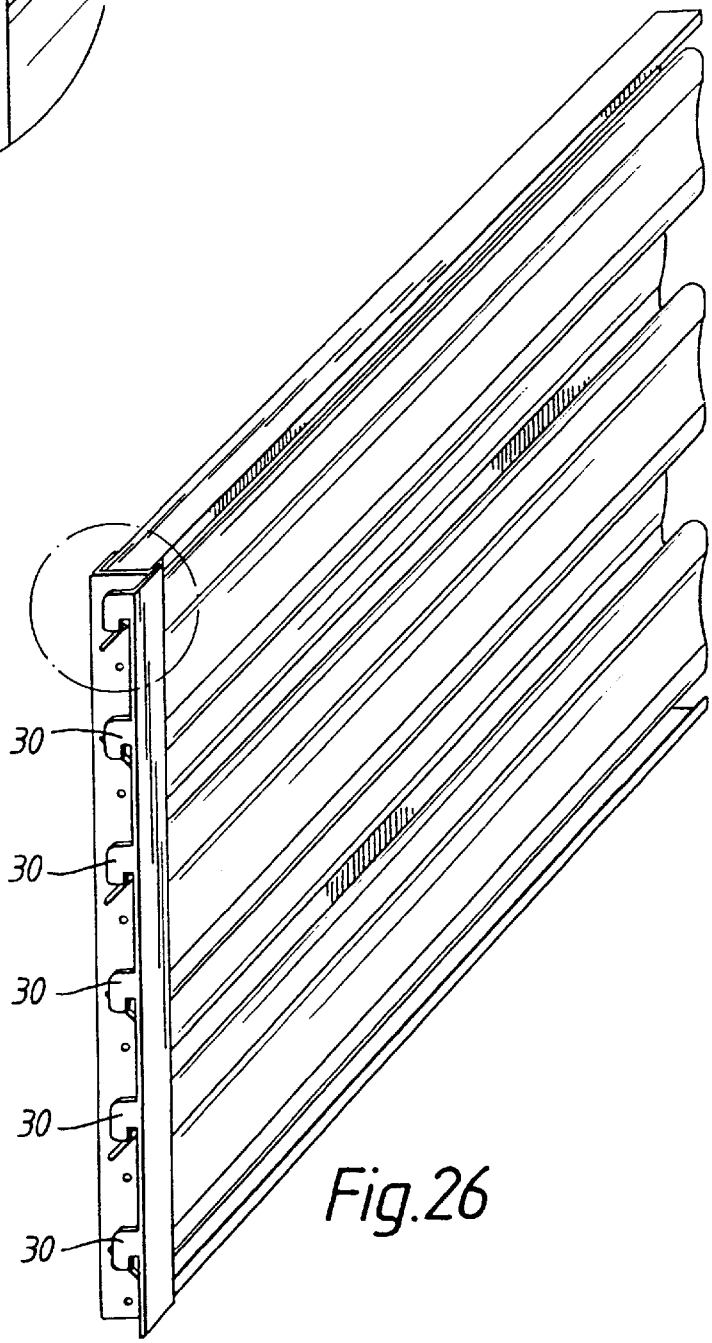
FIG. 26 shows a panel fitted with yet another form of edge strip.

FIGS. 23 and 24 illustrate such an edge trim applied to a panel with top and bottom edge flanges as shown in FIG. 22. The edge trim is manufactured from sheet metal which is bent to for a channel section to receive the panel edge, and stamped to provide the suspension hooks 30. The edge trim can be conveniently secured to the panel by screws or by spot welding. Another form of edge strip or trim providing suspension hooks 30 is shown in FIG. 25, the trim in this embodiment have an L-shaped cross section. Yet a further form of edge trim is illustrated in FIGS. 26 and 27, and in this embodiment the sheet metal from which the strip is formed is bent to provide a channel section and a flange carrying the suspension hooks spaced beyond the panel edge. Of course various other forms of edge panel are also possible. When panels are formed with edge flanges 60 as in FIGS. 22 and 23, two panels can be secured together one above the other by clamp blocks having respective block portions shaped to fit the half channels at the adjacent edges of the two panels and separated by a slot in which the abutting flanges 60 are received. FIGS. 28 and 29 show an alternative form of attachment clip to that of FIG. 15 for connecting a horizontal support rod to a panel. The clip has a front plate 40, an L-shaped upper mounting portion 42 and a resilient lower mounting portion 43. A tubular boss 41 extends through the front plate and is reinforced by an upright web at the rear of the front plate and possibly additional webs at the front of this plate. The boss defines a horizontal hole to receive the rod to be supported.

Figure 30:
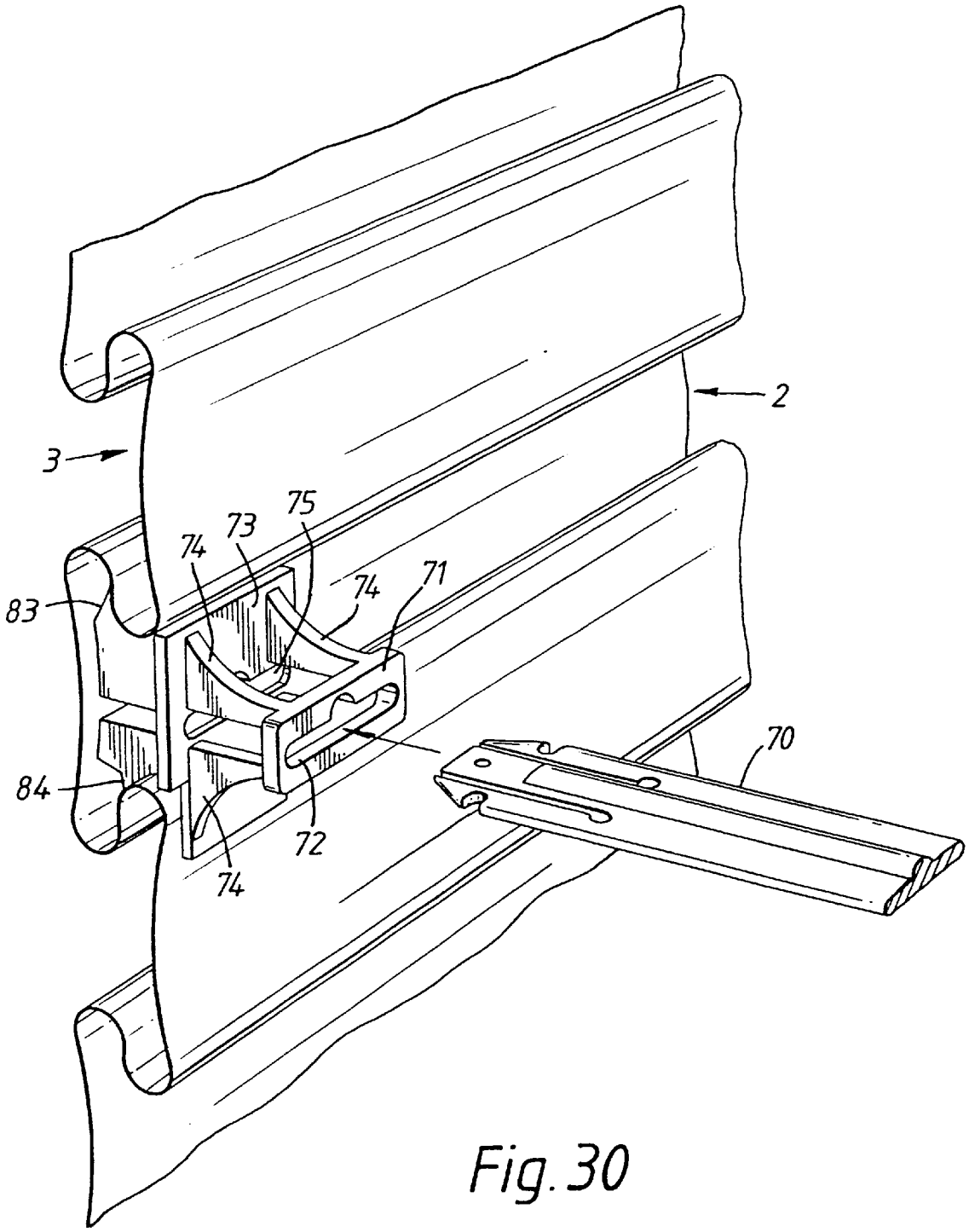
FIGS. 30 and 31 are perspective and side views showing another form of attachment clip fitted to a panel and suitable for supporting a product display hook.
Figure 31:
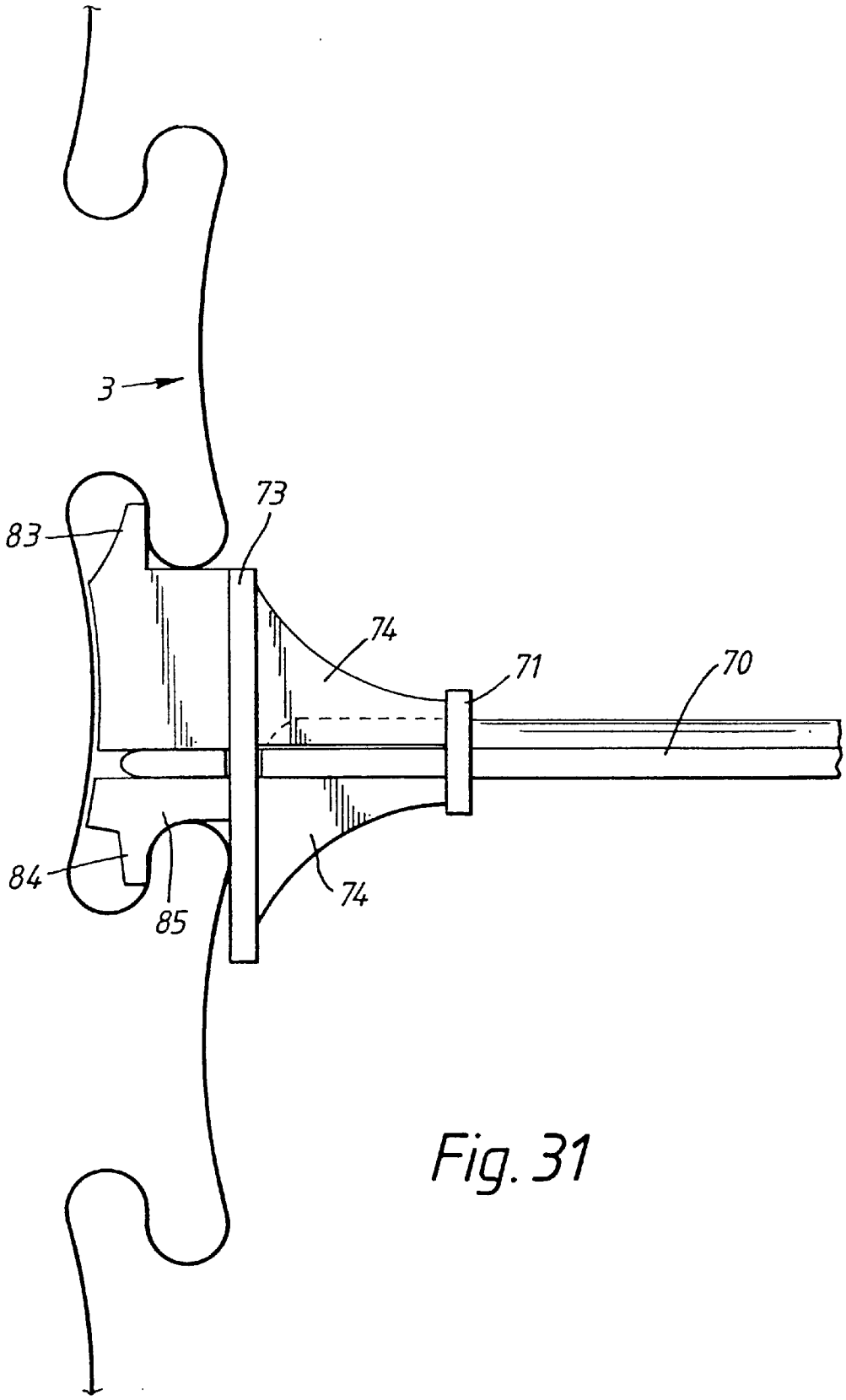

FIGS. 30 and 31 illustrate another form of attachment clip shown fitted to a panel and adapted to receive a so-called display hook 70 on which products to be sold may be supported for display to customers. The clip has a front wall 71 with an opening 72 of complementary shape to the cross-section of the main part of the display hook arm. The clip includes a rear wall 73 to which the front wall is connected by four legs 74, and which is provided with an opening 75 which is narrower than the opening 72 so that when the rear end of the display hook arm is pushed into the opening its latch fingers engage the rear wall 73. For further details of the display hook 70 reference can be made to European Patent Application No. 96308921.4. Behind the rear wall 73 the clip has a rigid upper mounting flange 83 for engagement in the recess defined by the upper side wall of a channel 2 of the structural panel, and a lower flange 84 carried by a resilient tongue 85 for engagement with the lower side wall of the channel 2. The lower mounting flange allows the clip to be snapped into the channel 2 by first inserting the upper flange 83 and then rotating the clip to press the lower flange into place as shown in the drawings. The lower flange 84 becomes held in the locking position by the arm of the display hook 70 when the latter is inserted into the mounting clip.

Figure 32:
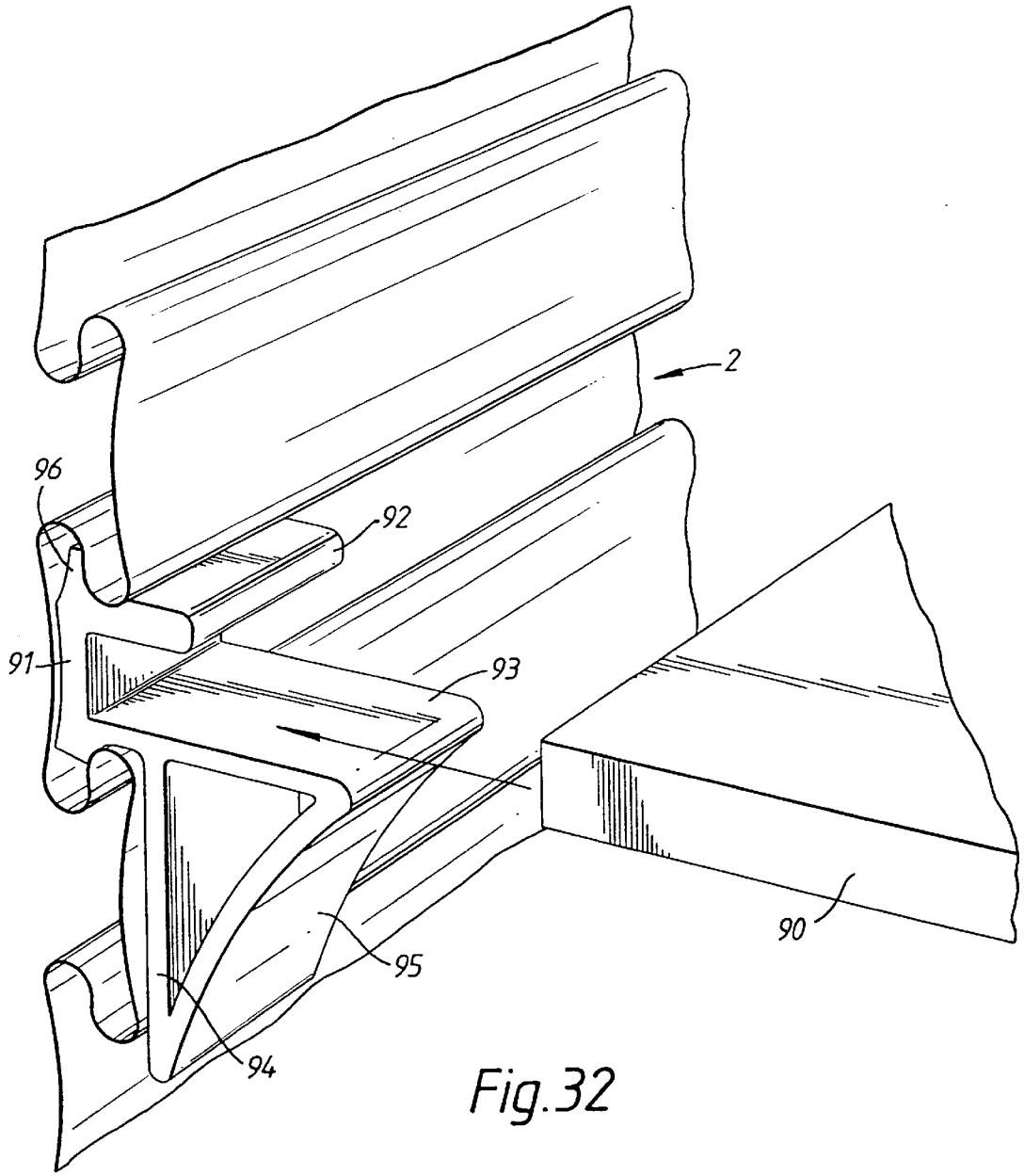

The attachment clip illustrated in FIG. 32 has the form of a support bracket for a shelf 90 or the like. The clip has a rear wall 91 with forwardly projecting upper and lower support parts 92,93 between which the edge of the shelf fits with a friction fit. The lower support part has a depending leg with one member 94 arranged to rest against the supporting panel and a second member 95 which extends between the forward edge of the lower shelf support part 93 and the lower end of the member 94. The rear wall includes a rigid upper flange 96 for engaging in the recess defined by the upper side wall of the channel 2 into which the shelf bracket is fitted, and a lower flangle 97 which engages the lower side wall of the channel with a snap fit. When the shelf 90 is fitted into the bracket the bracket is locked against detachment from the support panel 1.

What is claimed is:

1. A panel assembly comprising a structural formed from sheet material and comprising on each face of the panel a series of parallel channels (2,3) with substantially the same re-entrant cross-sectional shape, and a support member engageable with one of said channels, wherein the support member is an attachment clip releasably engageable with a snap-fit in said one of said channels (2,3) of the panel, the one of said channels having recesses defined at the opposite sides of the one of said channels, and the support member having mounting portions which engage in the respective recesses.

2. A panel assembly according to claim 1, wherein each of the channels has an upper side wall defining a downwardly open recess and a lower side wall defining an upwardly open recess, the attachment clip includes a substantially, rigid upper mounting portion (43) for engagement in the downwardly open recess defined by the upper side wall of the channel, and a resilient lower mounting portion (42) for engagement with the lower side wall of the channel.

3. A panel assembly according to claim 2, wherein the upper and lower mounting portions (42,43) engage the surface of the panel only within the channel.

4. A panel assembly according to claim 1, wherein the clip is arranged to receive a member which assists in maintaining the clip in secure attachment with the panel.

5. A panel assembly according to claim 1, wherein each of the channels has a lower side wall defining an upwardly open recess, and the attachment clip engages the lower side wall of the channel so that the upwardly open recess defined by the lower side wall extends past the clip and is substantially unobstructed thereby.

6. A wall assembly comprising a panel formed from sheet material and comprising on each face of the panel a series of parallel channels (2,3) with substantially the same re-entrant cross-sectional shape, at least one side edge of the panel having integral tabs, and an elongate support post (31), the integral tabs having the form of hooks (30) and the post having slots (32) for receiving the hooks, and the hooks having a complementary shape to edge portions of the post to allow the panel to be supported with the edge thereof closely adjacent the post.

7. A structural panel formed from a single piece of sheet material, the panel comprising:

(i) a first side with a series of parallel channels with substantially the same re-entrant cross-sectional shape;

(ii) a second side with a series of parallel channels with substantially the same re-entrant cross-sectional shape;

(iii) the panel having front and rear faces respectively defined by said first and second sides;

(iv) each of the channels having a base wall and opposed side walls, with each side wall being substantially S-shape in cross-section to define recesses facing in opposite directions and separated by a side wall part substantially parallel to the base wall; and wherein (v) the channels on the first side of the panel are formed by successively pressed sheet portions bent between press tooling to form channels extending the full width of the sheet material; and (vi) the channels on the second side are defined between sheet portions forming adjacent channels on the first side and have substantially the same cross-sectional shape and size as the channels on the first side.

8. A structural panel according to claim 7, wherein the width of the panel in the lengthwise direction of the channels is not less than 0.5 meters, the height of the panel is at least one meter, the channels have a maximum width in the range of 4 to 8 cm and a depth in the range of 1 to 3 cm.

9. A structural panel according to claim 7, wherein at least one of the side edges of the panel between which the channels (2,3) extend is provided with means (30) fixed thereto for mounting the panel to a supporting structure (31).

10. A structural panel according to claim 9, wherein the mounting means comprises integral tabs (30) formed from the panel sheet material.

11. A structural panel according to claim 9, wherein the mounting means comprises an edge fitting (60) securely fastened to (5) the panel.

12. A structural panel according to claim 11, wherein the edge fitting (60) includes projections (63) corresponding in shape to the cross-section of the channels to permit assembly of the panel with a similar panel in a T formation.

13. A structural panel according to claim 7, wherein a stiffening bar is attached to one side of the panel to extend substantially perpendicularly to the channels (2,3), the stiffening bar being interlocked with the channels (2) on said one side of the panel.

14. A structural wall panel according to claim 13, wherein the stiffering bar includes two clongate sections (50–54) connected together after bringing the sections into cooperation with the panel independently of each other.

15. A structural panel according to claim 14, wherein the elongate sections (50–54) are of substantially the same form and longitudinally reversed in orientation.

16. A structural panel formed from a single piece of sheet material comprising on each side thereof a series of parallel channels with substantially the same re-entrant cross-sectional shape, said panel having front and rear faces respectively defined by said sides, each channel having a base wall and opposed side walls, each side wall being substantially S-shape in cross-section to define recesses facing in opposite directions, and each side wall including a side wall part substantially parallel to the base wall; wherein the channels are formed by successively pressed sheet portions bent between press tooling to form channels extending the full width of the sheet, and wherein a channel on one side of the panel is located adjacent an upper edge of the panel, and a channel on the other side of the panel is located adjacent a lower edge of the panel, the upper most and lower most edges of the panel defining oppositely directed hook portions enabling similar panels to be mounted one above the other with the hook portion at a lower edge of one panel interengaged with the hook portion at an upper edge of the other panel, thereby to form a continuous panel assembly.

17. A method of manufacturing a panel from sheet material, the panel having channels extending across the panel on each side thereof, the method comprising the steps of:

(i) feeding a portion of sheet material between shaped tooling elements;

(ii) deforming the sheet portion by moving the tooling elements so that the sheet portion is bent into substantially U-shaped cross-section defining a channel base and two opposed sides;

(iii) deforming each of the sides by moving the tooling elements together to bend each side into substantially S-shape and thereby form the sheet portion to a channel with a re-entrant cross-section extending the full width of the sheet material, the S-shape channel sides defining recesses facing in opposite directions and separated by a wall part substantially parallel to the channel base;

(iv) withdrawing the tooling elements from the re-entrant channel formed in the sheet portion;

(v) repeating steps (i) through (iv) to form a series of transverse channels in sheet portions spaced along the sheet material, during each step (i) of feeding sheet material the sheet material being advanced by such an amount that between each pair of successively formed re-entrant channels formed on one side of the panel there is defined on the other side of the panel a re-entrant channel of substantially the same cross-sectional shape and size as the channels on the one side of the panel, the finished panel having front and rear faces respectively defined by said one and other sides.

18. A method according to claim 17, wherein the step of withdrawing the tooling elements from the re-entrant channel includes withdrawing a tooling part through the mouth of the channel and causing tooling elements pivotally mounted to the tooling part to pivot to enable removal of these tooling elements through the channel mouth.

19. A method according to claim 17, wherein during the pressing of each sheet portion the tooling also acts on an area of the sheet material adjacent the channel formed by pressing said portion thereby to produce a predetermined non-flat formation in said area.

20. Tooling for use in carrying out the method of claim 17, comprising two tool assemblies for receiving and shaping the sheet material therebetween, the first assembly including a shaping part (17–19) for deforming a portion of sheet material into a recess defined between a pair of opposed tool elements (21,22) of the second assembly, thereby to deform the sheet portion into a substantially U-shaped cross-section, the opposed tool elements (21,22) being movable towards each other for deforming the side walls of the channel into substantially S-shape, and the shaping part of the first tool assembly having elements (18,19) pivotally movable to enable removal of the shaping part from the channel upon the tool assemblies being opened apart.

21. Tooling according to claim 20, wherein means (23) are provided for moving the opposed tool elements (21,22) towards each other in response to continued movement of the tooling assemblies towards each other after the U-shaped channel has been formed.

22. Tooling according to claim 21, wherein the moving means comprise levers (23) having respective arms bearing against a stationary tool member (10) and the opposed tool elements (21,22).

* * * * *